US009746239B2

(12) United States Patent
Grabolle et al.

(10) Patent No.: US 9,746,239 B2
(45) Date of Patent: Aug. 29, 2017

(54) DEVICE FOR DRYING WOOD

(71) Applicants: Christoph Grabolle, Kassel (DE); Stefan Noll, Körle (DE)

(72) Inventors: Christoph Grabolle, Kassel (DE); Stefan Noll, Körle (DE)

( * ) Notice: Subject to any disclaimer, the term of this patent is extended or adjusted under 35 U.S.C. 154(b) by 0 days.

(21) Appl. No.: 14/650,327

(22) PCT Filed: Dec. 4, 2013

(86) PCT No.: PCT/EP2013/075483

§ 371 (c)(1),
(2) Date: Sep. 21, 2015

(87) PCT Pub. No.: WO2014/086827

PCT Pub. Date: Jun. 12, 2014

(65) Prior Publication Data

US 2016/0025412 A1 Jan. 28, 2016

(30) Foreign Application Priority Data

Dec. 6, 2012 (DE) ..... 10 2012 111 892

(51) Int. Cl.

| | |
|---|---|
| ***F26B 23/10*** | (2006.01) |
| ***F26B 25/12*** | (2006.01) |
| *F26B 17/00* | (2006.01) |
| *F26B 25/00* | (2006.01) |
| *F26B 25/16* | (2006.01) |

(52) U.S. Cl.

CPC ..... *F26B 23/10* (2013.01); *F26B 25/12* (2013.01); *F26B 17/001* (2013.01); *F26B 25/002* (2013.01); *F26B 25/16* (2013.01); *F26B 2200/24* (2013.01)

(58) Field of Classification Search

CPC ..... F26B 21/00; F26B 23/00; F26B 23/10; F26B 17/001; F26B 2200/24; F26B 25/12; F26B 25/002; F26B 25/16; B29C 45/00; B29C 45/03

USPC ..... 34/396, 242; 44/590, 606

See application file for complete search history.

(56) References Cited

U.S. PATENT DOCUMENTS

| | | | | |
|---|---|---|---|---|
| 1,846,474 A * | 2/1932 | Darling | F26B 13/00 | 34/335 |
| 3,285,514 A | 11/1966 | Smith, Jr. | | |
| 3,750,303 A * | 8/1973 | Gates | B27B 31/00 | 34/201 |
| 3,986,268 A * | 10/1976 | Koppelman | F26B 3/34 | 34/257 |
| 4,182,048 A * | 1/1980 | Wolfe | F26B 3/04 | 34/396 |
| 4,371,375 A * | 2/1983 | Dennis, Jr. | F26B 17/003 | 34/173 |

(Continued)

FOREIGN PATENT DOCUMENTS

| | | | | |
|---|---|---|---|---|
| DE | 102012111892 A1 * | 6/2014 | F26B 23/10 | |
| DE | WO 2014086827 A1 * | 6/2014 | F26B 23/10 | |

(Continued)

*Primary Examiner* — Stephen M Gravini
(74) *Attorney, Agent, or Firm* — David P. Dickerson

(57) ABSTRACT

The invention relates to a device for drying wood, comprising: a container (1) for accommodating the wood (2) and a plate (4, 4', 4") forming a wall (3) of the container (1, 1', 1", 1"), wherein the plate (4) can be heated and wood (2) at least partially lies against the plate (4).

11 Claims, 6 Drawing Sheets

(56) References Cited

Figure 1:
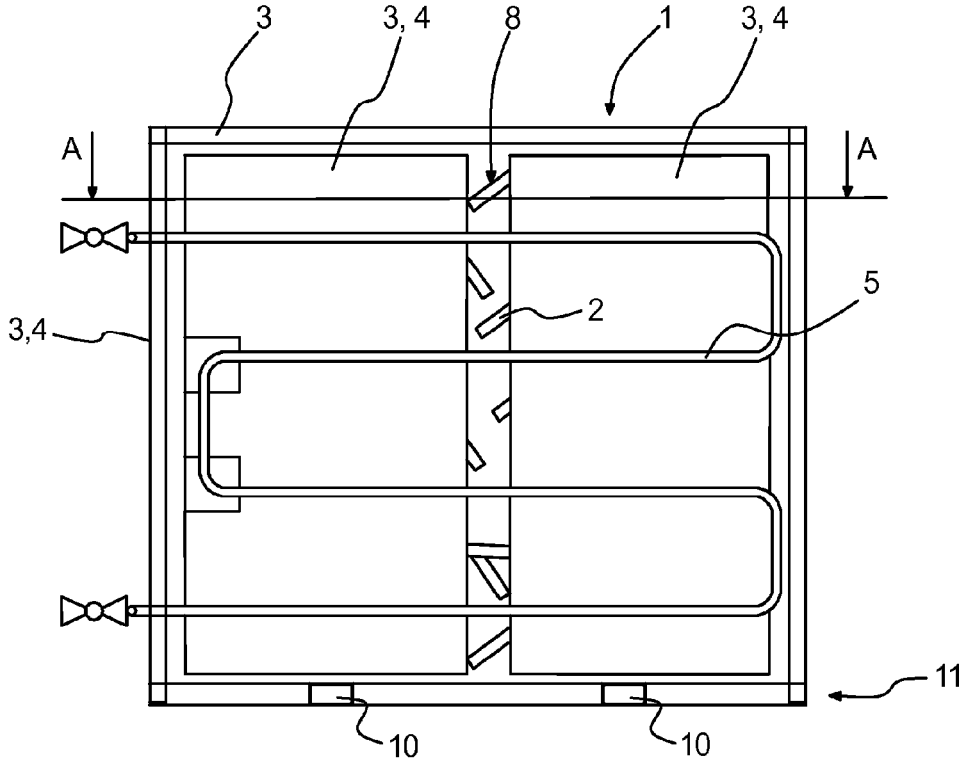

U.S. PATENT DOCUMENTS 4,620,373 A * 11/1986 Laskowski ..... F26B 3/20 34/403
5,836,086 A * 11/1998 Elder ..... F26B 3/04 34/396
5,881,476 A * 3/1999 Strobush ..... F26B 13/10 34/210
5,979,074 A * 11/1999 Brunner ..... F26B 21/022 34/396
6,119,364 A * 9/2000 Elder ..... F26B 3/04 34/212
7,676,953 B2 * 3/2010 Magill ..... G01N 27/223 144/380
7,963,048 B2 * 6/2011 Pollard ..... F26B 15/12 110/315
8,096,064 B2 * 1/2012 Matsunaga ..... F26B 7/00 34/396
8,397,400 B2 * 3/2013 Choo ..... B27K 1/00 110/244
8,726,539 B2 * 5/2014 Potter ..... F26B 9/02 165/54
8,875,414 B2 * 11/2014 Blomquist ..... F26B 3/04 104/172.3
8,904,668 B2 * 12/2014 Priebe ..... F26B 3/22 101/450.1
2008/0263890 A1 * 10/2008 Picard ..... B30B 15/34 34/282
2010/0024244 A1 * 2/2010 Potter ..... F23N 1/025 34/474
2015/0345865 A1 * 12/2015 Rivera ..... B65G 39/18 198/572
2016/0025412 A1 * 1/2016 Grabolle ..... F26B 23/10 34/344

FOREIGN PATENT DOCUMENTS

DE 102012111892 B4 * 4/2016
FR 2511078 A1 2/1983
GB 1582143 * 12/1980
GB 1582143 A 12/1980
KR RU 2182291 C2 * 5/2002
WO 2012042099 A1 4/2012
WO 2012127182 A2 9/2012

* cited by examiner

DEVICE FOR DRYING WOOD

The invention relates to a device for drying wood having a chamber for receiving the wood.

Such devices for drying wood are known per se. Wood to be dried is introduced into a container and dried by a heated air stream. For this, ambient air is introduced from the outside and heated and passed through the containers. The heated air also heats the wood, so that water contained in the wood evaporates and is transported from the container with the air. Due to the necessity to heat air and to lead such air via a blower or the like through the containers, a high thermal and mechanical performance effort, respectively, is currently required for drying wood in such devices. Utilizing heated air for heating may furthermore cause a purely near-surface warming, which may lead to a sealing of near-surface cavities in the wood.

It is therefore an object of the present invention, to reduce the performance effort required for drying wood.

The object is achieved with a device according to claim 1 and a method according to claim 11. Some embodiments of the invention are subject of the dependent claims, which can be combined with each other in a technologically worthwhile manner. Thereby, effects that go beyond the sum of the individual effects described below may at least partially be obtained. The description, in particular in connection with the drawings, characterizes and specifies the invention additionally.

According to claim 1, there is provided a device for drying wood, comprising:

a container for accommodating the wood;

a plate forming a wall of the container, wherein the plate can be heated and wood at least partially lies against the plate.

The moist wood to be dried can be arranged in the container and removed from the container after the drying process. The heat needed for drying the wood can be introduced via the plate. Furthermore, a pressure difference at which air must be passed through the container is reduced, whereby the power needed for the blower is reduced accordingly. The energy needed for drying wood is reduced at this device, since the spatial distance between the heat register or the heating elements, respectively, is cancelled by virtually utilizing the containers as heating elements. This makes it possible to heat the wood in a warm-up phase utilizing all three major forms of heat transfer, namely heat radiation from the plates to the wood, heat conduction between the plates and the wood, and heat transfer by convection from the plates to the air and from the so heated air to the wood. Since the distance between the plates and the wood is relatively small, no fans may be required for the heat transfer by convection. Fans will be used in one drying phase to replace the water-laden air in the container with dry air. Thus, the Energy needed for drying wood is less than in the known prior art.

The mentioned device is adapted to perform a method for drying wood, comprising the steps of:

placing wood in a container;

introducing heat via heatable plates arranged at the container, the heatable plates being heated to less than 150° C., in particular to less than 90° C., venting the container by ambient air.

The ambient air may be cold air that is fed from the outside. It is an advantage of this method that the heat is transferred from the plates to the wood by heat radiation. Thereby, the wood is heated evenly. The heated air will be discharged as soon as the air reaches a high relative humidity and can absorb no or only little more water. To expedite the drying process, circulation fans can be provided. The drying process is shortened in time by about 30 to 40%.

In a first advantageous embodiment it is provided to arrange pipes at the plate that are fluid-conducting connectable to a heating facility.

The heating facility can be in particular a boiler that is heated with wood or scrap wood and/or waste heat form a biogas facility. A basic idea underlying the invention is to improve the sustainability of wood as an energy source and, thus, to consider the overall efficiency from the deforestation to the burning at the customer. Namely, when other energy sources and/or high amounts on electric power have to be spent for drying wood, then they are to be included in the total balance sheet. By utilizing scrap wood or waste, which cannot be sold anyway, for drying wood, the sustainability of wood as an energy source can be improved.

In a further advantageous embodiment, the pipes are connected with the plate by a welding.

Due to this embodiment, a connection between the pipes and the plate is provided that is characterized by good heat conduction.

In a further advantageous embodiment of the welding, the pipes are connected with the plate by two weld seams, which are positioned on both sides of the pipes and run parallel to the pipes.

The weld seams are, thus, an integral connection between the plate and an outer surface of the pipes, such that a large heat transfer from the pipes to the plates is made possible.

According to a further embodiment, the container is at least partially tiltable.

Due to this embodiment, it is possible to tilt the container together with the wood placed within for a more easy removal of the wood from the container after the drying.

According to a further embodiment, the plate can be tilted from a horizontal position to a tilted position.

Due to this alternative or supplemental embodiment of a tiltable chamber, the plates can be tilted to the tilted position for removal of the wood from the container, whereupon the wood can be removed from the container using suitable means.

According to a further embodiment, a conveyor for conveying wood from the container is arranged below the plate, wherein wood lying on the plate slides in the tilted position onto the conveyor.

The conveyor enables transport of dried wood from the container. Thus, the drying process can be executed partially automated.

According to a further embodiment, the plate can be pulled horizontally from the container over a longitudinally movable actuator.

The longitudinally movable actuator may be a linear motor, a hydraulic or pneumatic cylinder, or a rack and pinion drive. Thus, the actuator enables the extraction of the plates after the drying process and/or prior to the loading of the container with wood to be dried.

According to a further embodiment, a plurality of plates is arranged on top of each other.

The plurality of superposed plates may be tiltable arranged in the container, as described above, and/or may be pulled horizontally from the container over the previously described actuator. Therefore, for filling the container with wood to be dried the plates positioned further down can be uploaded first and successively the further up positioned plates. For the unloading of the container, the further down positioned plates may initially be removed, whereupon the dried wood may be removed downwards from the container using suitable means.

According to a further embodiment, a conveyor is arranged inside the container for unloading the container, wherein the plates are positioned relative to the conveyor such that wood arranged on the plates falls onto the conveyor during the pulling out of the plates.

The conveyor may be a continuous belt, for example, a broadened metal chain and/or a textile or rubber band. The conveyor enables a quick and partially automated unloading of the container.

According to a further embodiment, it is provided to heat the ambient air prior to introduction into the containers to a temperature below 80° C., particularly below 70° C., and more particularly below 60° C.

The air will be heated to temperatures below those provided in the prior art. Facilities for heating air are relatively powerful such that they need a high energy input during operation. The high energy input reduces the overall efficiency of conventional drying facilities that heat the wood with heated air. By heating the air to lower temperatures, it can absorb the moisture contained in the wood well.

According to a further embodiment, the introduction of heat through the plate takes place during a heating phase that extends over a time period of one to six days, particular between one and four days. The venting of the container takes place preferably during a drying phase that extends over a time period of one to ten days, particularly between two and eight days. During the drying phase, ambient air can discontinuously be supplied, for example, in intervals of about 10 min, to force the water-laden air from the container and to absorb further moisture. The ambient air can be heated as described in the preceding paragraph.

The term wood includes especially split logs or with cutting tools shredded wood in the form of so-called wood chips. Also, wood elements produced using blunt or smashing tools in form of so-called shredded wood, wood residues, Smallwood, wood cuttings, and matured timber are included in the term wood.

Figure 2:
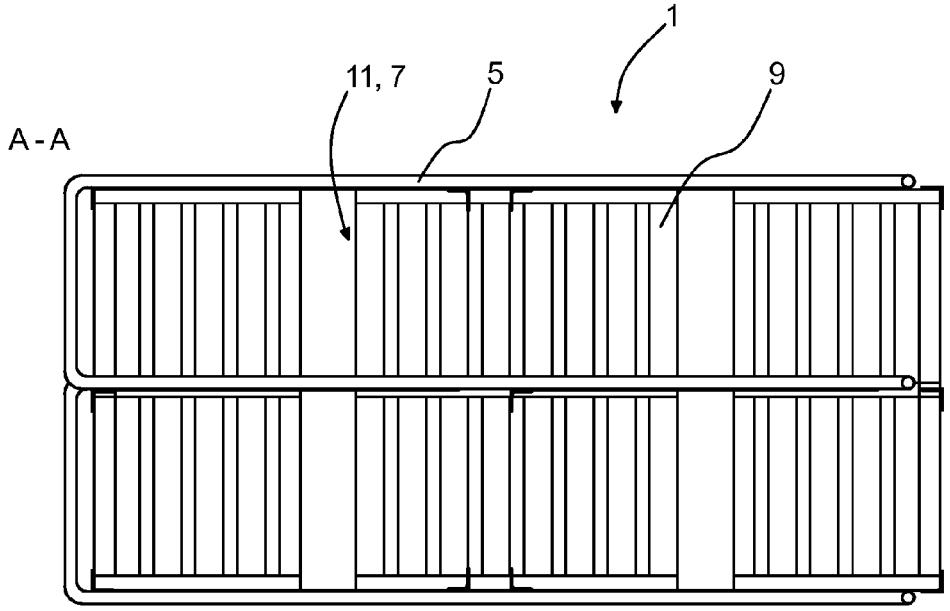
Figure 3:
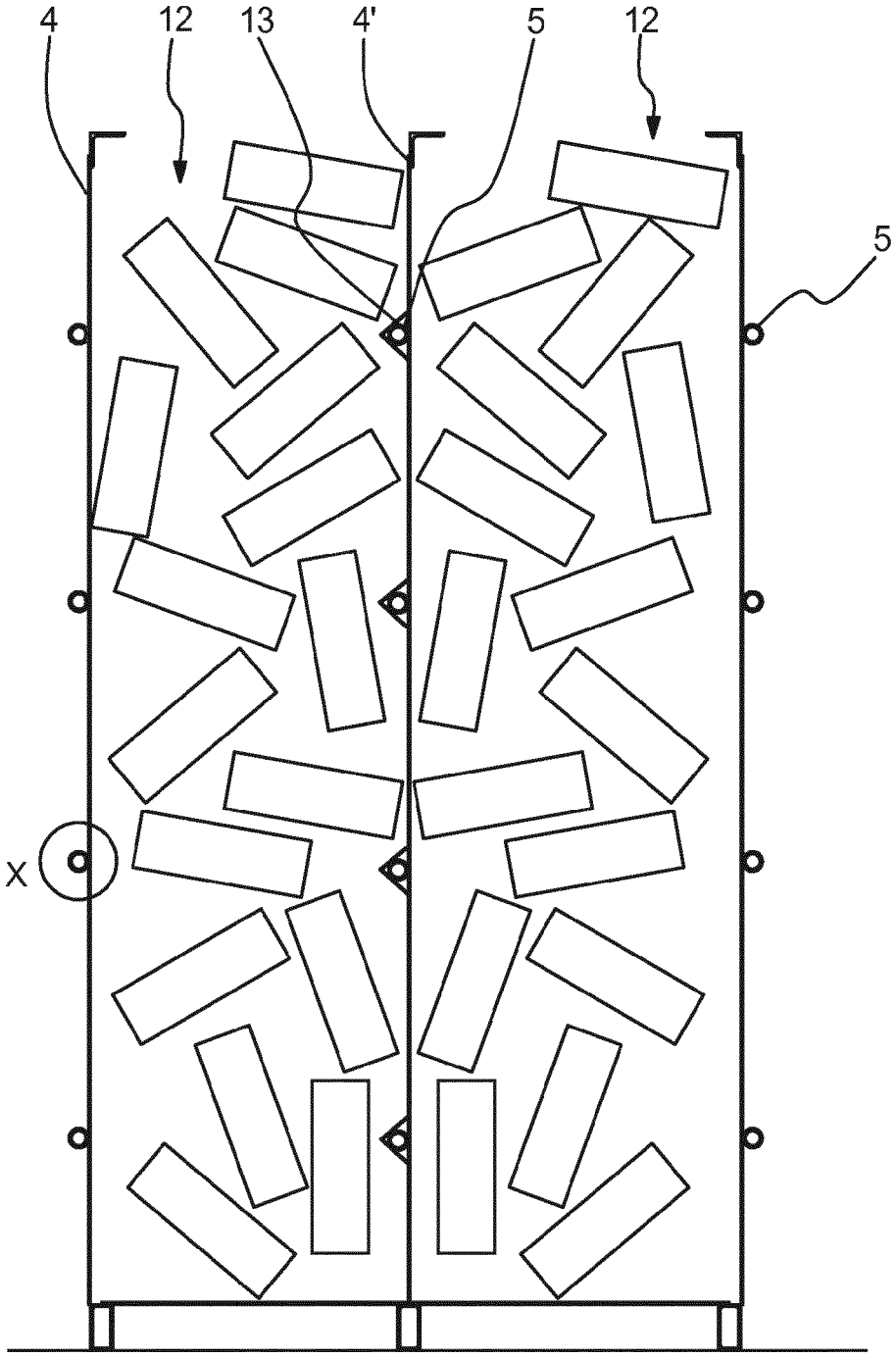
Figure 4:
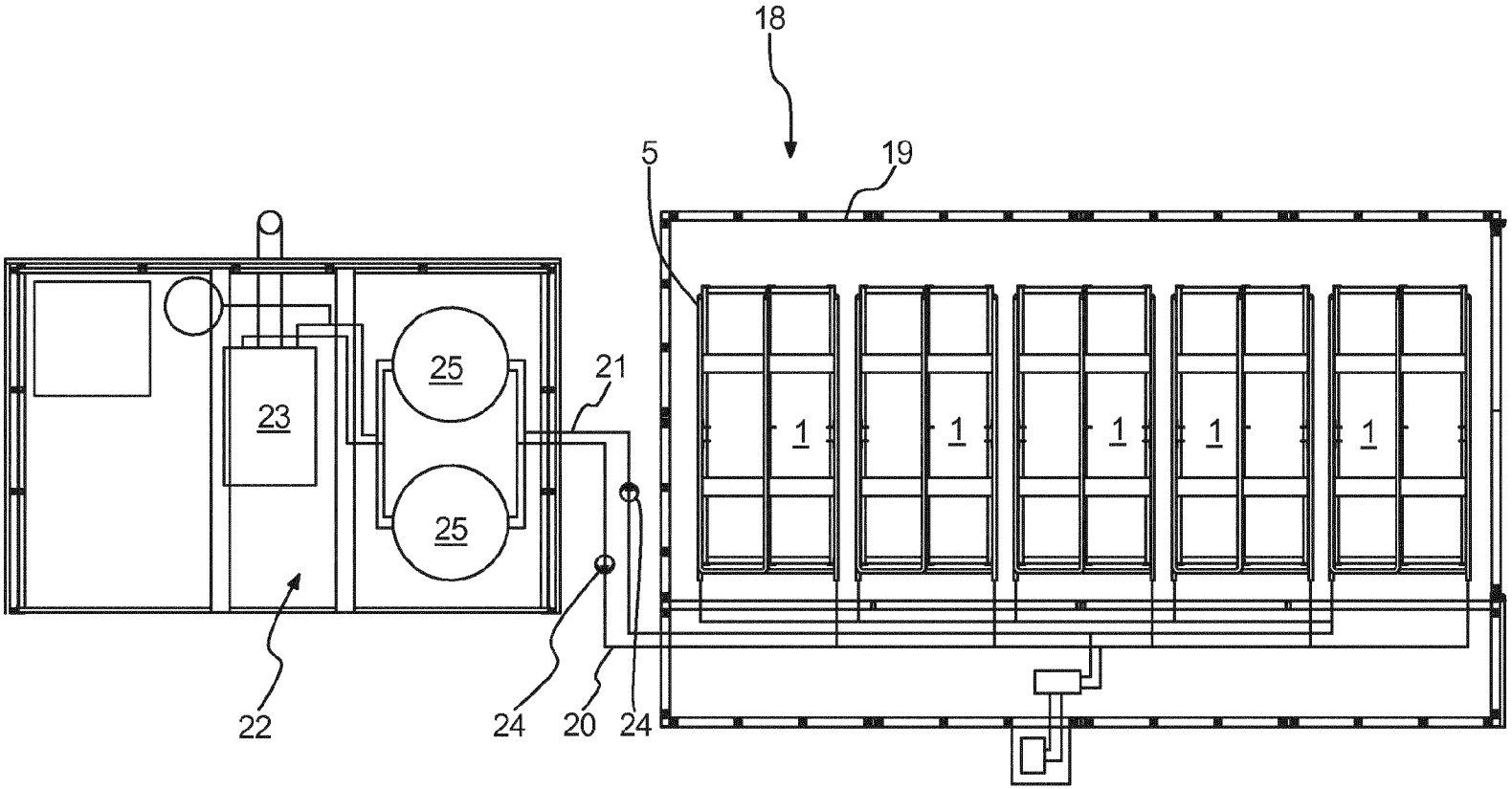
Figure 5:
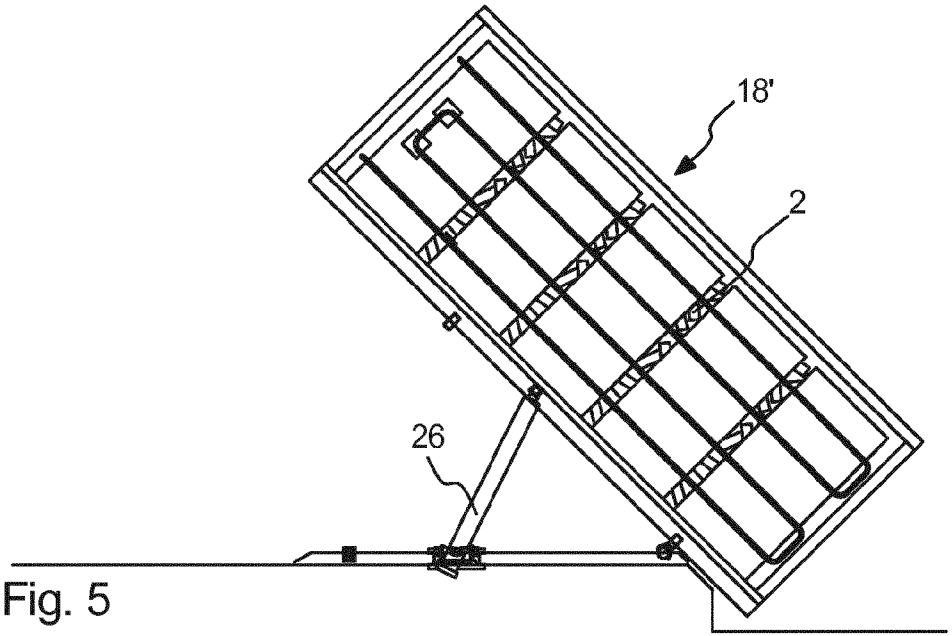
Figure 7:
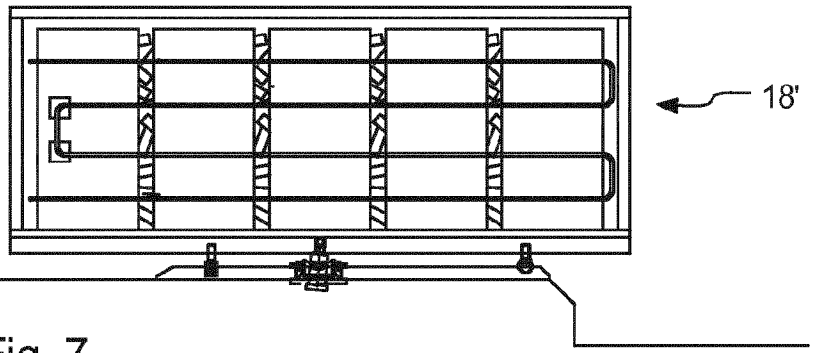
Figure 6:
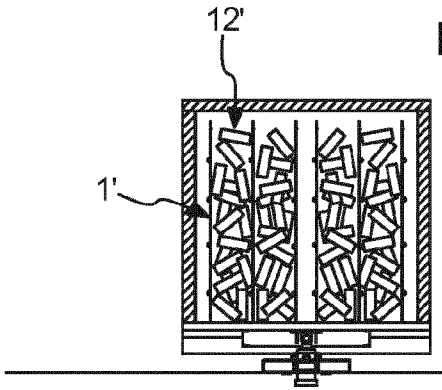
Figure 9:
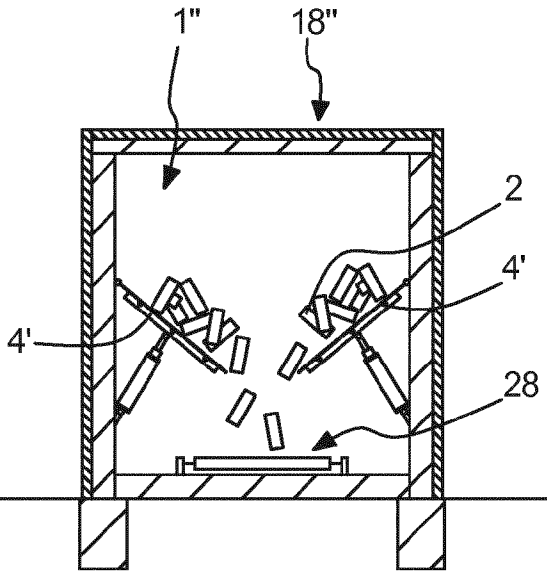
Figure 8:
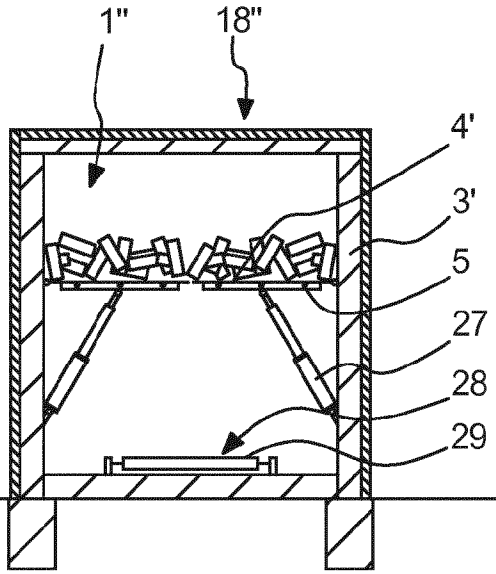
Figure 10:
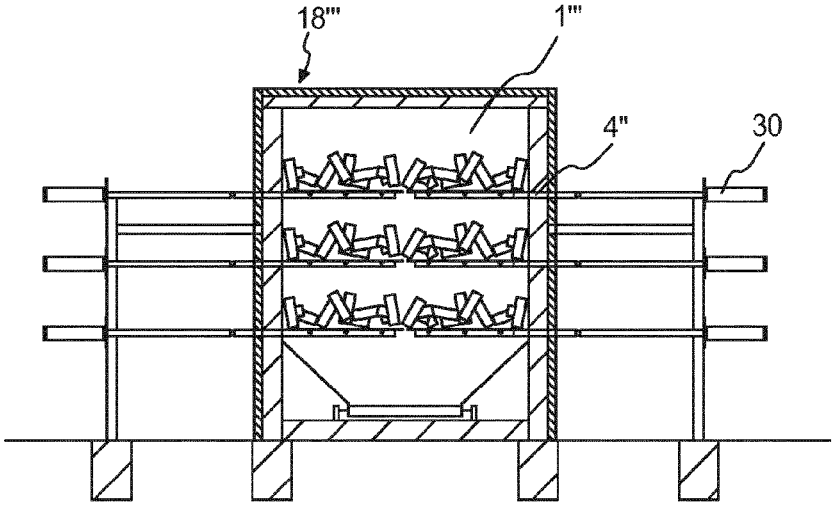
Figure 11:
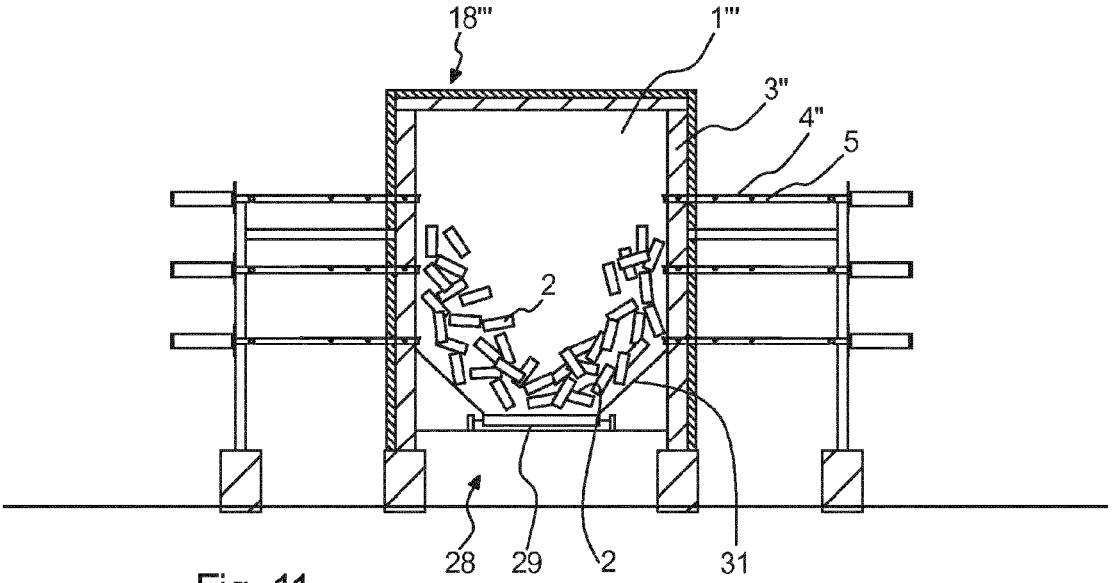
Figure 12:
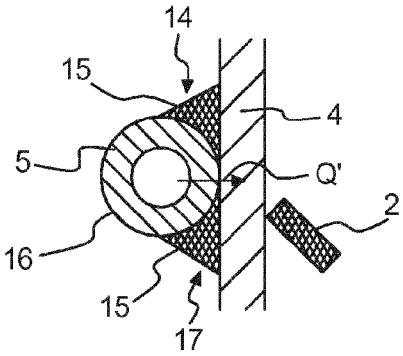

In the following, embodiments will be explained in more detail with reference to the drawings. Shown are:

FIG. 1: schematically in a side view an embodiment of a container for drying wood with heatable plates arranged thereon, FIG. 2: schematically a cross-section of the container, marked in FIG. 1 with "A", FIG. 3: schematically a cross-section of the container, marked in FIG. 1 with "B", FIG. 4: schematically in a cross-sectional top view a drying chamber for drying wood with containers, a heating facility, a flow line for heated water and a return line for chilled water arranged therein, FIG. 5: schematically a side view of an embodiment with a tiltable container that is in a tilted position, FIG. 6: schematically a cross-section through the container with wood arranged within, FIG. 7: schematically a side view of the tilted container that is in a horizontal position, FIG. 8: schematically in cross-section an embodiment of a device for drying wood with tiltable heatable plates and a conveyor, wherein the plates are in a horizontal position, FIG. 9: schematically in cross-section the device for drying wood shown in FIG. 8 in a state where the plates are in a tilted position and on the plates arranged wood slides onto the conveyor, FIG. 10: schematically in cross-section a further embodiment of a device for drying wood with a plurality of plates arranged on top of each other, which can sideways be pulled out from the container over actuators, FIG. 11: schematically in cross-section the embodiment shown in FIG. 10, where the plates are pulled out sideways and wood arranged on them falls onto a conveyor, FIG. 12: a detailed view marked with "X" in FIG. 3 with a pipe welded onto the plate.

In the drawings, some or similar elements, respectively, are provided partly with the same reference numerals.

FIG. 1 shows from a side view a container 1, which is adapted for receiving wood (2). The container 1 is constructed essentially prismatic from a plurality of walls 3. At least one wall 3 that comes directly in contact with the wood 2 is designed as a heatable plate 4. For heating plate 4, there is a meandering pipe 5 welded to the plate 4. The pipe 5 is flowable through with a heated fluid, particularly water. During operation the heated fluid transfers heat to the pipe 5. The so heated pipe 5 transfers the heat to plate 4. Accordingly, plate 4 is heatable. Between the plates 4 there are free spaces 8 for venting the container 1. It is provided that at least two opposite sides and, therefore, a left and right side or an upper and a lower side are permeable to air. Optimal results can be achieved when all sides are permeable to air. The free spaces 8 improve the process of removal of humid air.

The pipe 5 can be connected with a conduit, in particular a flexible conduit, in a manner not shown. According to an embodiment the pipe 5 can be separated from the conduit to transport or move the container 1 for filling with the wood to be dried and for emptying the dried wood and for tilting. The transport can, for example, be done with a forklift truck, that has rotatable forks. The pipe 5 can be shut off using ball valves 6, such that the water within the pipe does not leak during the transport. To facilitate the lifting and transport of the container 1 with the forklift truck, steel profiles 10, which are also closed below, are provided in a bottom region 11 such that the container 1 can be rotated on the forks of the fork lift truck to discharge dried wood 2.

FIG. 2 shows schematically a cross-section of the container 1, marked in FIG. 1 with "A". An air permeable bottom 7 is arranged in the bottom region 11. The air permeability is achieved with spaced profile members.

FIG. 3 shows schematically a cross-section of the container 1, marked in FIG. 1 with "B". The container 1 includes two chambers 12 for receiving the wood 2. At two outside positioned plates 4 pipes 5 are arranged on the side facing away from the wood 2. At an inside positioned plate 4' the pipes 5 are mounted on a side facing the wood 2. The pipes 5 are covered with a V-shaped protective sheet 13 such that the wood does not damage the pipes 5 during the filling or emptying, respectively, of the container 1.

An enlarged area that is marked with "X" in FIG. 3 is illustrated in FIG. 12. It can be seen that the pipes 5 are connected with the plates 4 via a welding 14. The welding 14 is formed by two weld seams 15 that run parallel to the pipes 5. The weld seams 15 serve both for mechanical fixation of the pipes 5 to the plates 4 and also for improving the heat transfer from the pipes 5 to the plates. The weld seams are applied relatively bulky, such that they cover nearly half of the surface 16 of a pipe 5 and cover a possibly large area in the region of a connection 17 of the weld seam 15 to the plate 4. This embodiment enables a high heat transfer Q' from the pipes 5 or the therein positioned water, respectively, to the plates 4. The plates 4 transfer the heat immediately to the wood 2. The heat transfer takes place mainly through heat radiation, heat conduction, and heat transfer by convection and this in close proximity to the wood such that losses can be kept low.

For industrial use, a container 1 may have a height between 0.2 and 3.2 m, particularly between 0.5 and 3 m, a width between 1 and 4.2 m, particularly between 1.2 and 4 m and a depth between 0.2 and 3.3 m, particularly between 0.5 and 3 m. For these dimensions, a pipe length of the meandering and in the above mentioned manner welded pipe 5 of about 15 to 30 m is suitable for realizing a large heat transfer from the water to the wood.

FIG. 4 shows in a partially sectioned view schematically a device for drying wood including a drying chamber 18, which is insolated towards the outside with insulation panels 19. Within the drying chamber 18, there are several containers 1 arranged, which are provided as already described. The containers 1 are connected with a heating facility 22 via a flow line 20 and a return line 21. The heating facility 22 includes a solid fuel burner 23, in which an inflammable material, particularly wood, can be burned, in a manner not shown, to heat the water. For example, wood chips with an automatic feeder may be used for heating and/or a biogas plant. In two buffer reservoirs 25, shown in a top view, heated water can be accumulated. The heated water reaches the flow line 20 through pumps 24. From the flow line 20, heated water is diverted and directed to the pipes 5 of each container 1. Valves, which are not shown and which may be manually or automatically opened and closed completely or partially, may be provided for uniform distribution of the heat to the containers 1. Through the return line 21 cooled water gets back into the heating facility 22 (two-pipe-system). Nevertheless, if desired, a one-pipe-system that is not shown in the drawings may be utilized. The described heating facility 22 may also be used for heating the drying chambers 18', 18", and 18'", as shown in FIGS. 5 to 11. It is considered to be particularly advantageous that die heat is transferred directly to the wood and water is used as an intermediate medium, which transfers heat virtually without loss and, thus, directly from the heating facility to the wood.

FIG. 5 shows a tiltable drying chamber 18' in a tilted position. A plurality of heatable plates 4 are arranged within the drying chamber 18'. The entire drying chamber 18' may be tilted using a hydraulic cylinder 26 such that the wood 2 may be unloaded easily. FIG. 6 shows the drying chamber 18' illustrated in FIG. 5 in a front vie. the drying chamber 18' includes a plurality of continuous chambers 12'. FIG. 7 shows the container 1' in a non-tilted, horizontal position.

FIG. 8 shows a further embodiment of a drying chamber 18" having tiltable plates 4'. The plates 4' are tiltably connected with the walls 3' of the drying chamber 18" and may be tilted by an actuator 27 from a horizontal position, illustrated in FIG. 8, to a tilted position, illustrated in FIG. 9. The actuator 27 may, for example, be comprised of a hydraulic or pneumatic cylinder. The drying chamber 18" includes at least two plates 4' arranged at opposite walls 3'. The plates 4' include at their bottom side pipes 5, where heated water can flow through in a manner already described. A conveyor 28 is arranged immediately beneath the plates 4' that can transport wood from the drying chamber 18' via a rotating belt 29. The plates 4' are positioned relative to the conveyor 28 at the walls 3' such that wood arranged on them falls onto the conveyor 28, see FIG. 9. With this configuration, the drying process can be at least partially automated, since the wood 2 to be unloaded can be removed from the drying chamber 18" without manual intervention.

The FIGS. 10 and 11 show in a further embodiment a drying chamber 18" having a plurality of plates 4" that can be pulled out from the container 1'" or drying chamber 18'", respectively. The plates 4" are longitudinally movable arranged in opposite walls 3" of the container 1'". The plated 4" can be pulled out via an actuator 30, as shown in FIG. 11. The actuator 30 may be comprised of a hydraulic or pneumatic cylinder, a linear drive, or a rack and pinion. To unload the container the plates 4" may be pulled out via the actuators 30. The wood 2 falls onto a conveyor 28 such that it can be transported from the container 1'". To ensure that no wood 2 falls next to the conveyor 28, inclined guiding sheets 31 are provided.

LIST OF REFERENCE NUMERALS

1 container
2 wood
3 wall
4 plate
4' plate
4" plate
4'" plate
5 pipe
6 ball valve
7 bottom
8 free space
9 profile element
10 steel profile
11 bottom region
12 chamber
12' chamber
13 protective sheet
14 welding
15 weld seam
16 surface
17 connection
18 drying chamber
18' drying chamber
18" drying chamber
18'" drying chamber
19 insulation panel
20 flow line
21 return line
22 heating facility
23 solid fuel burner
24 pump
25 buffer reservoir
26 hydraulic cylinder
27 actuator
28 conveyor
29 belt
30 actuator
31 guiding sheet

The invention claimed is:

1. A wood drying device, comprising:

a tiltably mounted receptacle having a floor;

a heating system; and a plate heatable by said heating system to radiate heat, said plate forming a wall of said receptacle substantially perpendicular to said floor, said plate being arranged such that wood comprising at least one of logs and split logs received in said receptacle lies at least partially against said plate;

said tiltably mounted receptacle being tiltable from a configuration in which said floor is substantially horizontal to a configuration in which said floor is significantly angled relative to horizontal to ease unloading of said wood from said receptacle.

2. The device of claim 1, said heating system comprising:

at least one pipe connectable to a source of heated fluid and arranged to transfer heat from said fluid to said plate.

3. The device of claim 2, wherein said at least one pipe is welded to said plate.

4. The device of claim 3, comprising, for at least one of said at least one pipe, a first weld connecting a first side of the respective pipe to said plate and a second weld connecting a second side of the respective pipe to said plate.

5. A wood drying device, comprising:

a drying chamber;

a heating system; and a tiltably mounted plate for supporting wood comprising at least one of logs and split logs in said drying chamber, said plate being heatable by said heating system to radiate heat for drying said wood, and said plate being tiltable from a horizontal position to a tilted position.

6. The device of claim 5, comprising:

a conveyor for conveying wood from said drying chamber, wherein said conveyor is arranged below said plate such that wood lying on said plate slides, in said tilted position, onto said conveyor.

7. A wood drying device, comprising:

a drying chamber;

a heating system;

a plate for supporting wood comprising at least one of logs and split logs in said drying chamber; and an actuator, wherein said plate is heatable by said heating system to radiate heat for drying said wood, and said plate is movable in a horizontal direction by said actuator such that at least a portion of said plate is moved from a position within said drying chamber to a position outside said drying chamber.

8. The device of claim 7, comprising, above said plate, a plurality of heatable plates, each for supporting a supply of wood in said drying chamber.

9. The device of claim 7, comprising:

a conveyor arranged inside said drying chamber, wherein said plate is positioned relative to said conveyor such that wood arranged on said plate falls onto said conveyor when said plate is moved from said drying chamber by said actuator.

10. A wood drying method, comprising:

placing wood comprising at least one of logs and split logs in a receptacle;

introducing heat via heatable plates arranged in said receptacle, the heatable plates being heated to a temperature selected from the group of less than 150° C. and less than 90° C., heating a volume of ambient air to a temperature selected from the group of below 80° C., below 70° C., and below 60° C., and introducing said heated volume of ambient air into said receptacle.

11. The method of claim 10, wherein said introduction of heat extends over a time period in a range selected from the group of one to six days and one to four days, and said venting extends over a time period in a range selected from the group of one to ten days and two and eight days.

* * * * *